US011268206B2

(12) United States Patent
Dal Zilio et al.

(10) Patent No.: US 11,268,206 B2
(45) Date of Patent: Mar. 8, 2022

(54) METHOD FOR INCREASING THE CORROSION RESISTANCE OF A CHROME-PLATED SUBSTRATE

(71) Applicant: COVENTYA S.P.A., Carugo (IT)

(72) Inventors: Diego Dal Zilio, Quinto di Treviso (IT); Andrea Martin, Silea (IT); Sandrine Dalbin, Maserada Sul Piave (IT)

(73) Assignee: COVENTYA S.P.A., Carugo (IT)

( * ) Notice: Subject to any disclaimer, the term of this patent is extended or adjusted under 35 U.S.C. 154(b) by 207 days.

(21) Appl. No.: 16/499,130

(22) PCT Filed: Apr. 3, 2018

(86) PCT No.: PCT/EP2018/058429

§ 371 (c)(1),
(2) Date: Sep. 27, 2019

(87) PCT Pub. No.: WO2018/178390

PCT Pub. Date: Oct. 4, 2018

(65) Prior Publication Data

US 2021/0108326 A1 Apr. 15, 2021

(30) Foreign Application Priority Data

Mar. 31, 2017 (EP) ..... 17164327

(51) Int. Cl.
*C25D 9/06* (2006.01)
*C25D 3/06* (2006.01)
(Continued)

(52) U.S. Cl.
CPC ..... *C25D 9/06* (2013.01); *C25D 3/06* (2013.01); *C25D 5/18* (2013.01); *C25D 5/623* (2020.08);
(Continued)

(58) Field of Classification Search
CPC ... C25D 3/06; C25D 5/18; C25D 9/06; C25D 9/08; C25D 11/38
See application file for complete search history.

(56) References Cited

U.S. PATENT DOCUMENTS 4,167,460 A 9/1979 Tomaszewski
6,004,448 A 12/1999 Martyak
(Continued)

FOREIGN PATENT DOCUMENTS

EP 2 201 161 B1 1/2015
JP 2009-074170 A 4/2009
(Continued)

OTHER PUBLICATIONS

European Patent Office, International Search Report in International Application No. PCT/EP2018/058429 (dated Apr. 26, 2018).
(Continued)

*Primary Examiner* — Brian W Cohen
(74) *Attorney, Agent, or Firm* — Leydig, Voit & Mayer, Ltd.

(57) ABSTRACT

The present invention relates to a method for increasing the corrosion resistance of a chrome-plated substrate wherein at least one part of a chrome-plated surface of a chrome-plated substrate is dipped into an electrolyte comprising trivalent chromium ions, at least one conducting salt and at least one reducing agent, and afterwards, a trivalent chromium oxide film is formed on the at least one part of the chrome-plated surface by applying a pulse reverse current between the chrome-plated surface and a counter electrode electrically connected with the chrome-plated surface through the electrolyte. Furthermore, the present invention relates to a chrome-plated substrate obtainable by this method.

14 Claims, 5 Drawing Sheets

(A)

(51) Int. Cl.

| | |
|---|---|
| ***C25D 5/18*** | (2006.01) |
| ***C25D 11/38*** | (2006.01) |
| ***C25D 9/08*** | (2006.01) |
| ***C25D 5/00*** | (2006.01) |

(52) U.S. Cl.
CPC ..... *C25D 5/625* (2020.08); *C25D 5/627* (2020.08); *C25D 9/08* (2013.01); *C25D 11/38* (2013.01)

(56) References Cited

U.S. PATENT DOCUMENTS

| | | | |
|---|---|---|---|
| 2001/0054557 | A1 | 12/2001 | Taylor et al. |
| 2014/0127532 | A1 | 5/2014 | Schiavon et al. |
| 2015/0064494 | A1 | 3/2015 | Wijenberg et al. |
| 2015/0101934 | A1 | 4/2015 | Dardona et al. |
| 2017/0009361 | A1 | 1/2017 | Dal Zilio et al. |
| 2019/0112712 | A1 | 4/2019 | Dalbin et al. |

FOREIGN PATENT DOCUMENTS

| | | | | |
|---|---|---|---|---|
| JP | 2009-235456 | A | 10/2009 | |
| WO | WO 98/40542 | A1 | 9/1998 | |
| WO | WO 2010/057001 | A2 | 5/2010 | |
| WO | WO 2015/007448 | A1 | 1/2015 | |
| WO | WO-2015110627 | A1 * | 7/2015 | ..... C25D 17/002 |
| WO | WO 2015/134690 | A1 | 9/2015 | |

OTHER PUBLICATIONS

European Patent Office, Written Opinion in International Application No. PCT/EP2018/058429 (dated Apr. 26, 2018).

International Bureau of WIPO, International Preliminary Report on Patentability in International Application No. PCT/EP2018/058429 (dated Oct. 1, 2019).

European Patent Office, Communication pursuant to Article 94(3) EPC in European Patent Application No. 18 713 706.2 (dated Mar. 30, 2020).

European Patent Office, Communication pursuant to Article 94(3) EPC in European Patent Application No. 18 713 706.2 (dated Oct. 7, 2020).

European Patent Office, Communication pursuant to Article 94(3) EPC in European Patent Application No. 18 713 706.2 (dated Apr. 6, 2021).

* cited by examiner (A)

METHOD FOR INCREASING THE CORROSION RESISTANCE OF A CHROME-PLATED SUBSTRATE

CROSS-REFERENCE TO RELATED APPLICATIONS

This patent application is the U.S. national phase of International Application No. PCT/EP2018/058429, filed on Apr. 3, 2018, which claims the benefit of European Patent Application No. 17164327.3, filed Mar. 31, 2017, the disclosures of which are incorporated herein by reference in their entireties for all purposes.

The present invention relates to a method for increasing the corrosion resistance of a chrome-plated substrate wherein at least one part of a chrome-plated surface of a chrome-plated substrate is dipped into an electrolyte comprising trivalent chromium ions, at least one conducting salt and at least one reducing agent, and afterwards, a trivalent chromium oxide film is formed on the at least one part of the chrome-plated surface by applying a pulse reverse current between the chrome-plated surface and a counter electrode electrically connected with the chrome-plated surface through the electrolyte. Furthermore, the present invention relates to a chrome-plated substrate obtainable by this method.

It is well known that many items are chrome-plated to give a metallic decorative aspect and to improve the corrosion resistance of the very same items.

Speaking of which, the chrome deposit is preceded by Ni and/or Copper deposits to give a bright aspect to the item and improve its corrosion resistance.

All such deposits are usually obtained by electroplating deriving from water-based electrolytes and from proper metals salts. Thanks to new REACH regulations, in recent years more and more chrome deposits obtained from trivalent chromium electrolytes have been used. Unlike the hexavalent chromium, trivalent chromium is not defined as toxic.

These new chrome-plated processes based on trivalent chromium can be of different types and defined as based on chlorides or based on sulfates. Then, each of them allows obtaining Cr deposits having different colors that may vary from dark colors to the one similar to Cr(VI) deposits. All Cr deposits obtained from a trivalent chromium electrolyte are alloys and may include C, N, O, S, Fe, Ni, while Cr deposits obtained from a hexavalent chromium electrolyte are almost pure.

In addition to that, considering the different nature of the Cr salts' two oxidation states, hexavalent chromium has the capability to passivate and protect other metals such as Ni, Cu, Fe, and their alloys and consequently to passivate unplated areas. Trivalent Cr does not have this ability.

Referring to the above-described features of Cr alloys' deposits that have been obtained from a trivalent Cr electrolyte, as well as the inability to naturally passivate other metals, it has been proved that items that have been chrome-plated through these trivalent Cr electrolytes highlight a corrosion resistance lower than items that have been chrome-plated using hexavalent Cr electrolytes.

A method that is usually required to test chrome-plated items' corrosion resistance is the Neutral Salt Spray Test according to ISO9227 NSST or ASTM b117. Requested results for neutral salt spray resistance depend upon the tested item type. Generally, from 24 h to 1000 h are required, depending on the item nature.

For plastics parts (ABS or ABS/Polycarbonate) dedicated to Automotive that have electrolytic Copper, Nickel and Chrome deposits, the request may vary from 480 h to 1000 h.

Generally, test passing occurs when there is no aspect change or corrosion appearance. The latter is highlighted by salinity formation due to the corrosion of Cr deposit's underlying metals.

The corrosion of Cr deposit's underlying metals might be Ni or Cu deposits or the very own item base material.

Cr deposits have a higher corrosion potential, that is why they are not subjected to corrosion by the test. Porosities and micro-cracking presence puts into contact underlying substrates with test saline solution causing their anodic corrosion.

It is recognized that, as included into EP 2201161 B1, using a post-treatment composed by an acidic electrolyte containing hexavalent Cr and applying a cathodic current to trivalent Cr electrolytic deposits, it is possible to obtain a very thin passivate film around 7 nm that does not alter the aspect but increases the corrosion resistance.

Obviously, even if it would be a functioning solution it does not fulfill the regulations requirements about hexavalent Cr removal from manufacturing processes.

In recent years, other documents have been published to solve this kind of problem, such as JP 2009-235456 or WO 2015/134690, a very similar one. They consider a post-treatment composed by an electrolyte containing a trivalent Cr salt, a complexing-agent (organic acids' type) and the cathodic current application to all trivalent Cr electrolytic deposits. In this way, it would be possible to increase the corrosion resistance.

These inventions require the use of high concentrations of trivalent chrome and are thus economically unfavourable. In addition, the corrosion resistance obtained from these electrolytes is rather limited. They also demonstrate that continuously using these trivalent Cr post-treatments, a certain amount of hexavalent Cr would be produced into the very own electrolytes, making them not usable from an industrial point of view.

Other post-treatments have been published with the aim to increase corrosion resistance of items chrome-plated using electrolytes based on Cr(III), as WO 2015/007448 and WO 2010/057001. Both of them do not use electrolytes that contain Cr(III) but use the current flow to increase its effect. Particularly, the first one uses cathodic polarization while the second one uses the anodic polarization. Nevertheless the corrosion resistance provided by these treatments is always inferior to the one provided by the chrome ions containing solutions.

Thus, it is the object of the present invention to provide a method for increasing the corrosion resistance of a chrome-plated substrate such that a high corrosion resistance of the substrate is achieved while the use and the formation of hexavalent chromium during the method can be avoided.

This object is achieved by the method described herein, by the substrate described herein, and the advantageous embodiments and developments thereof.

According to the invention, a method for increasing the corrosion resistance of a chrome-plated substrate is provided. The method contains the following steps:

a) Dipping at least one part of a chrome-plated surface of a chrome-plated substrate into an electrolyte, the electrolyte comprising trivalent chromium ions, wherein the concentration of the trivalent chromium ions in the electrolyte is in the range of 0.001 to 0.1 M, preferably in the range of 0.002 to 0.08 M, at least one conducting salt, wherein the concentration of the at least one conducting salt in the electrolyte is in the range of 2 to 50 g/L, preferably in the range of 5 to 30 g/L, and at least one reducing agent, wherein the concentration of the at least one reducing agent in the electrolyte is in the range of 0.1 to 50 g/L, preferably in the range of 0.1 to 10 g/L, more preferably in the range of 0.1 to 5 g/L, b) Forming a trivalent chromium oxide film on the at least one part of the chrome-plated surface by applying a pulse reverse current between the chrome-plated surface and a counter electrode electrically connected with the chrome-plated surface through the electrolyte.

The substrate used in the method according to the invention is a chrome-plated substrate and, thus, has a chrome-plated surface. The method according to the invention represents a post-treatment of a chrome-plated substrate in order to increase the corrosion resistance of the chrome-plated substrate. Preferably, the chrome-plated substrate used in this post treatment should have been obtained by trivalent chromium electroplating of an (initial) substrate, i.e. the chrome-plated surface of the substrate used in the method according to the invention should have preferably been produced by trivalent chromium electroplating.

In step a) of the method according to the present invention, at least one part of a chrome-plated surface of the chrome-plated substrate which corrosion resistance should be increased is dipped into an electrolyte. Afterwards, in step b), a pulse reverse current is applied between the chrome-plated surface, which is at least partly dipped into the electrolyte, and a counter electrode while the chrome-plated surface of the substrate and the counter electrode are electrically connected through the electrolyte. By this procedure, a specific trivalent chromium oxide film is formed on the at least one part of the chrome-plated surface that is dipped into the electrolyte.

The method according to the invention enables to create a trivalent chromium oxide film while increasing the corrosion resistance of the substrate without changing its decorative aspect. In detail, by using a specific trivalent chromium electrolyte in combination with a pulse reverse current, a consistent and uniform trivalent chromium oxide film is formed on the chrome-plated substrate. This specific film guarantees a high corrosion resistance to the substrate, underlined using the ISO9227 NSS standard.

The chrome-plated substrate without the specific chromium oxide film may be exposed to corrosion because the Cr deposit, i.e. the chrome-plating of the substrate, is neither continuous nor uniform. In fact, the Cr deposit always presents micro-porosities and/or micro-cracking. For this reason, the method according to the invention enables the formation of a consistent and uniform trivalent chromium oxide film. Due to its consistency and uniformity, this specific film is suitable for suppressing corrosion of the substrate.

Surprisingly, the method according to the present invention enables achieving a high corrosion resistance of the chrome-plated substrate without using any hexavalent chromium ions. Instead, the electrolyte used within the method according to the invention is a trivalent chromium electrolyte. Furthermore, the formation of hexavalent ions during the method can be avoided due to the presence of a reducing agent in the electrolyte. Thus, by using the method according to the present invention, the corrosion resistance of the chrome-plated substrate is increased such that a high corrosion resistance of the substrate is achieved while the use and the formation of hexavalent chromium during the method can be avoided. Furthermore, since a trivalent chromium electrolyte is used and the formation of hexavalent chromium is avoided in the method according to the present invention, the trivalent chromium oxide film formed on the chrome-plated substrate does not contain any hexavalent chromium ions.

According to the invention, a pulse reverse current is applied between the chrome-plated surface and a counter electrode electrically connected with the chrome-plated surface through the electrolyte. In this context, "pulse reverse current" means that the chrome-plated surface is polarized alternatively under cathodic and anodic polarity during the appliance of this current. Such pulse reverse current is schematically shown in FIG. 1.

The parameters of the pulse reverse current, such as the frequency, the current density and the duty cycle, may be adjusted such that they lie in specific preferred ranges. Thus, an even higher corrosion resistance of the chrome-plated substrate may be achieved.

In a preferred embodiment of the method according the invention, the pulse reverse current has a frequency (f) (i.e. a polarity inversion speed) in the range of 0.1 to 1000 Hz, preferably in the range of 0.5 to 100 Hz, more preferably in the range of 0.1 to 50 Hz. The frequency f corresponds to the reciprocal of the cycle time: $f=1/T$.

A further preferred embodiment is characterized in that the pulse reverse current has a current density ($j_{cat}$, $j_{ano}$) in the range of 0.01 to 10 A/dm$^2$, preferably in the range of 0.01 to 5 A/dm$^2$, more preferably in the range of 0.05 to 0.5 A/dm$^2$.

Furthermore, it is preferred that the duty cycle ($\gamma$) of the pulse reverse current is in the range of 40 to 95%, preferably in the range of 50 to 80%. The duty cycle is defined by the formula: $\gamma=t_{cat}/(t_{cat}+t_{ano})$, wherein $t_{cat}$ is the cathodic (forward) time and $t_{ano}$ is the anodic (reverse) time.

By using a reverse pulse current having a frequency, a current density, and/or duty cycles lying in the preferred ranges mentioned before, the corrosion resistance of the chrome-plated substrate can be further increased.

According to a further preferred embodiment of the method according to the invention, the pulse reverse current is applied for a time period from 30 to 300 seconds, preferably for a time period from 60 to 240 seconds. By applying the pulse reverse current for this preferred time period, a particular high corrosion resistance of the chrome-plated substrate can be achieved.

In a further preferred embodiment, the chrome-plated surface of the chrome-plated substrate has been obtained by trivalent chromium electroplating, i.e. by electroplating from an electrolyte containing trivalent chromium ions. Chrome-plated substrates that have been produced by hexavalent chromium electroplating, i.e. by electroplating from an electrolyte containing hexavalent chromium ions, may contain at least rests of hexavalent chromium ions. Hence, if such substrate is dipped into an electrolyte, there may be a risk that hexavalent chromium ions may get into the electrolyte. However, chrome-plated substrates produced by trivalent chromium electroplating do generally not contain such rests of hexavalent chromium ions since they have not been produced by using hexavalent chromium electrolytes. Consequently, such substrates are particularly suitable for the use in the method according to the invention since no hexavalent chromium ions are present within the chrome-plated substrate that may get into the electrolyte.

The Cr deposit that has been added to the surface of the substrate by trivalent chromium electroplating may have different shades depending upon the electrolyte used. The Cr deposit concerned may be a Cr alloy that contains one or more elements of the group consisting of Fe, Ni, C, O, N, and S.

A further preferred embodiment of the method according to the present invention is characterized in that the chrome-plated substrate comprises a main part made of plastic, preferably acrylonitrile butadiene styrene (ABS), and at least one under layer arranged on the main part, wherein the at least one under layer is composed of a deposit selected from a metal, a metal alloy or mixtures thereof. More preferably, the at least one under layer is composed of a deposit selected from the group consisting of nickel, alloys of nickel, copper, alloys of copper, and mixtures thereof. Due to the combination of the specific electrolyte and the pulse reverse current, the method according to the invention is particularly suitable for increasing the corrosion resistance of such specific substrates based on plastic. For example, the chrome-plated substrate comprises a main part made of plastic, in particular ABS, one under layer made of copper arranged on the main part, and three under layers made of nickel arranged, one upon the other, on or above the under layer of copper. This exemplary substrate is chrome-plated and, thus, contains a chrome layer, i.e. a chrome-plating, on its surface, i.e. on the outer one of the three nickel layers.

The under layer deposits may be exposed to corrosion because the Cr deposit, i.e. the chrome-plating of the substrate, is neither continuous nor uniform. In fact, the Cr deposit always presents micro-porosities and/or micro-cracking. For this reason, the method according to the invention enables the formation of a trivalent chromium oxide film suitable for suppressing corrosion taking place between the underlying deposit and the final Cr deposit into micro-inconsistencies therein included.

According to the invention, the electrolyte, into which the at least one part of the chrome-plated surface of the chrome-plated substrate is dipped, comprises trivalent chromium ions, at least one conducting salt and at least one reducing agent. The aim of the conducting salt is to assign conductivity to the electrolyte while the reducing agent prevents the formation of hexavalent chromium. It is preferred that the electrolyte is an aqueous electrolyte. Furthermore, the electrolyte should not contain hexavalent chromium ions in order to avoid toxicity caused by such ions of the electrolyte and the product obtained by the method of the invention.

In a preferred embodiment, the concentration of the trivalent chromium ions in the electrolyte is in the range of 0.002 to 0.08 M. A concentration of 0.002 M corresponds to 100 ppm while a concentration of 0.08 M corresponds to 4 g/L.

A further preferred embodiment is characterized in that the electrolyte comprises at least one trivalent chromium salt comprising the trivalent chromium ions. This means that the trivalent chromium ions present in the electrolyte have been introduced into the electrolyte as a trivalent chromium salt. According to this preferred embodiment, the electrolyte, into which the at least one part of the chrome-plated surface of the chrome-plated substrate is dipped, may comprise at least one trivalent chromium salt (that comprises trivalent chromium ions), at least one conducting salt and at least one reducing agent. The at least one trivalent chromium salt is preferably selected from the group consisting of chromium sulfate, chromium potassium sulfate, chromium chloride and mixtures thereof.

Preferably, the concentration of the at least one conducting salt in the electrolyte is in the range of 5 to 30 g/L.

Preferably, the at least one conducting salt does not comprise trivalent chromium ions.

Furthermore, it is preferred that the at least one conducting salt is selected from the group consisting of sulfates, nitrates, phosphates, carbonates, bicarbonates, acetates, chlorides, and mixtures thereof. It is particularly preferred that the at least one conducting salt is selected from the group consisting of sodium sulfate, potassium sulfate, ammonium sulfate, sodium nitrate, potassium nitrate, ammonium nitrate, sodium phosphate, potassium phosphate, ammonium phosphate, sodium carbonate, potassium carbonate, ammonium carbonate, sodium bicarbonate, potassium bicarbonate, ammonium bicarbonate, sodium acetate, potassium acetate, ammonium acetate, sodium chloride, potassium chloride, ammonium chloride, and mixtures thereof.

It is, furthermore, preferred that the concentration of the at least one reducing agent in the electrolyte is in the range of 0.1 to 10 g/L, more preferably in the range of 0.1 to 5 g/L. If the concentration of the at least one reducing agent is below 0.1 g/L, Cr(VI) is created.

Furthermore, it is preferred that the at least one reducing agent is selected from the group consisting of sulfites, metabisulfites, thiosulfates, hydrosulfites, hydrazine, hydroxylamine, hydroxylammonium salts, ascorbic acid, sodium ascorbate, potassium ascorbate, formic acid, sodium formate, potassium formate, glyoxylic acid, sodium glyoxylate, potassium glyoxylate, glyoxal, glucose, sorbitol, and mixtures thereof.

A further preferred embodiment is characterized in that the electrolyte comprises at least one Cr(III) complexing agent.

In a particularly preferred embodiment, the electrolyte consists of at least one trivalent chromium salt, at least one conducting salt, at least one reducing agent, water and, optionally, at least one Cr(III) complexing agent.

Furthermore, it is preferred that the pH value of the electrolyte is in the range of 2 to 10.

The counter electrode used in the method according to the invention has the scope to close the circuit with the chrome-plated surface of the substrate. According to a preferred embodiment, the counter electrode is made of stainless steel, graphite, or titanium. The counter electrode is preferably covered by a mixed metal oxide or platinum.

The present invention also relates to a chrome-plated substrate having a continuous and uniform trivalent chromium oxide film on at least one part of its chrome-plated surface, wherein the trivalent chromium oxide film does not contain any hexavalent chromium ions.

The chrome-plated substrate according to the invention differs from chrome-plated substrates known from the state of the art that have been treated by a known post-treatment using a trivalent chromium electrolyte for increasing their corrosion resistance in that it exhibits a continuous and uniform trivalent chromium oxide film on at least one part of its chrome-plated surface. This specific film guarantees a high corrosion resistance to the substrate. Following this, the chrome-plated substrate according to the invention has a higher corrosion resistance than chrome-plated substrates known from the state of the art that have been post-treated using a trivalent chromium electrolyte according to a post-treatment known in the state of the art. In other words, chrome-plated substrates post-treated according to a post-treatment known in the state of the art using a trivalent chromium electrolyte only contain trivalent chromium oxide films that are not continuous and not uniform, which results in these known chrome-plated substrates having a low corrosion resistance.

Furthermore, the chrome-plated substrate according to the invention differs from chrome-plated substrates known from the state that have been treated by a known post-treatment using a hexavalent chromium electrolyte for increasing their corrosion resistance in that they contain a trivalent chromium oxide film that does not contain any hexavalent chromium ions. Films for corrosion resistance formed on chrome-plated substrates by using a hexavalent chromium electrolyte always contain at least rests of hexavalent chromium ions.

Preferably, the chrome-plated substrate according to the invention is obtained by a method according to the present invention or obtained by one of the preferred embodiments of the method according to the present invention.

The present invention also relates to a chrome-plated substrate that has been obtained by the method according to the present invention.

In a further preferred embodiment, the trivalent chromium oxide film of the chrome-plated substrate has a thickness from 5 to 15 nm, preferably from 7 to 13 nm, more preferably from 9 to 11 nm. It has been found that such specific thickness results in an increased corrosion resistance of the chrome-plated substrate. It is assumed that such specific thickness of the trivalent chromium oxide film leads to a more continuous and more uniform trivalent chromium oxide film. The film thickness may be measured by the method described on page 14, second paragraph.

The subject according to the invention is intended to be explained in more detail with reference to the subsequent figures and examples without wishing to restrict said subject to the special embodiments shown here.

EXAMPLES

Figure 1:
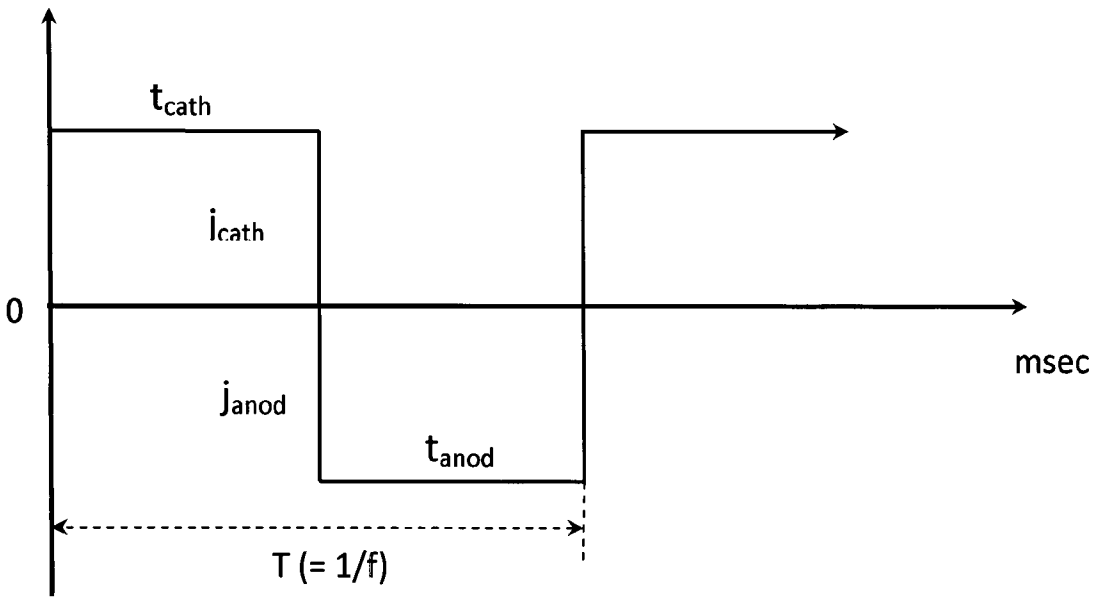
FIG. 1 is a graph that explains schematically the general wave shape for the pulse reverse current used in the method according to the invention. T (=1/f) is the cycle time.
Figure 2:
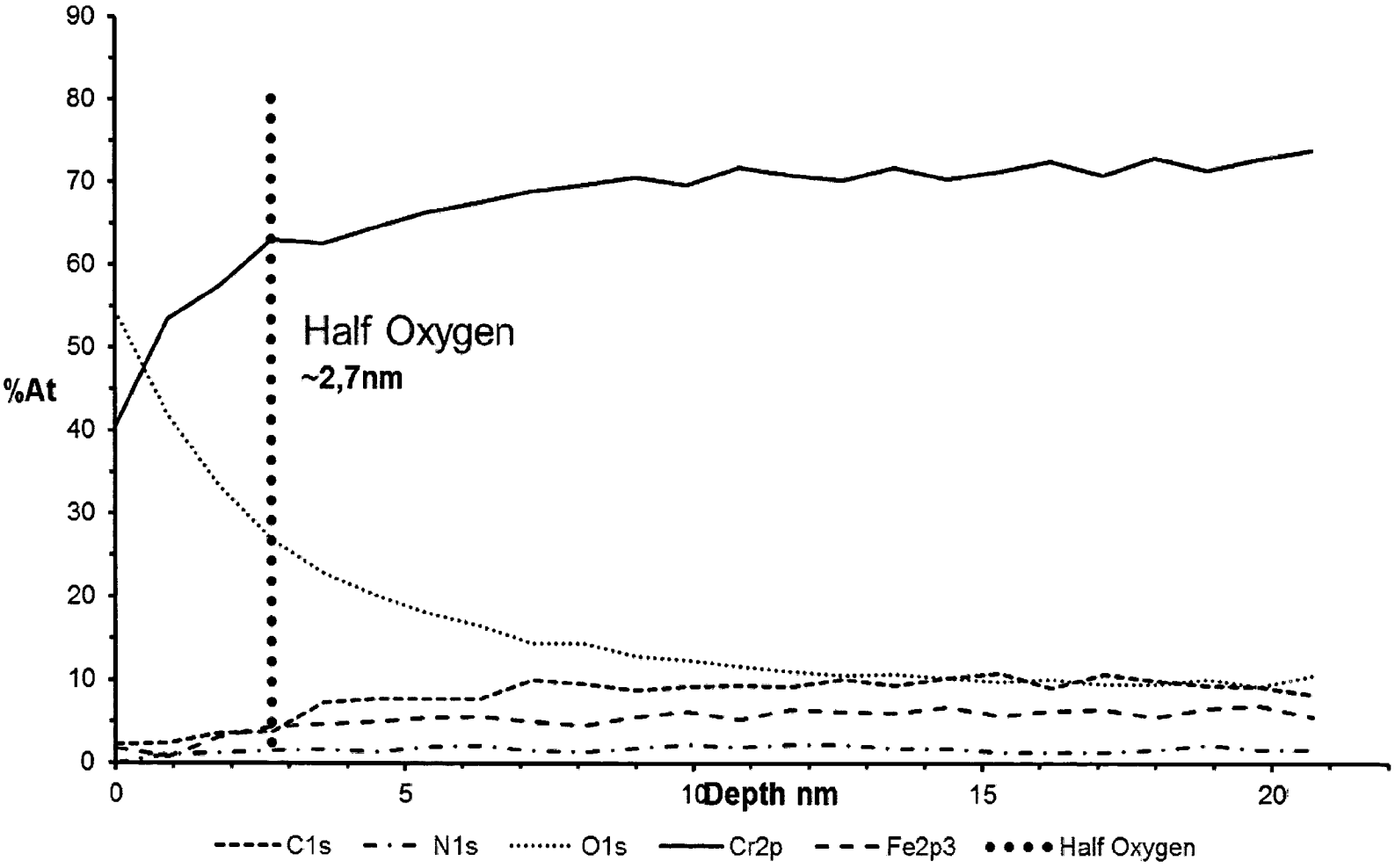
FIG. 2 is a graph that shows the results of XPS profile analysis in the chrome-plated surface obtained by an electrolyte based on trivalent chromium chloride without post treatment as described in example 1.
Figure 3:
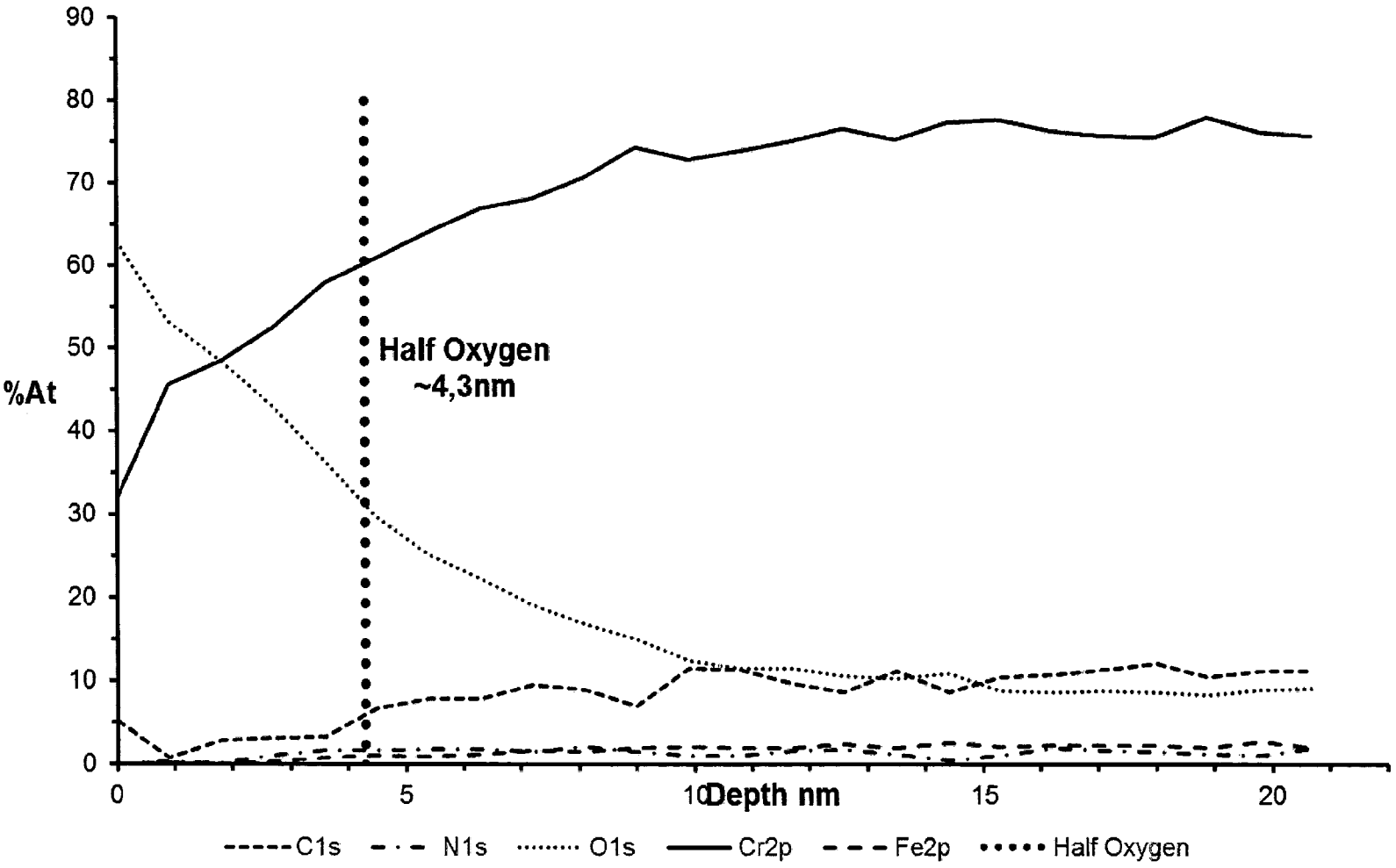
FIG. 3 is a graph that shows the results of XPS profile analysis in the chrome-plated surface obtained by an electrolyte based on trivalent chromium chloride, which was treated with a cathodic post treatment based on hexavalent chromium as described in example 4.
Figure 4:
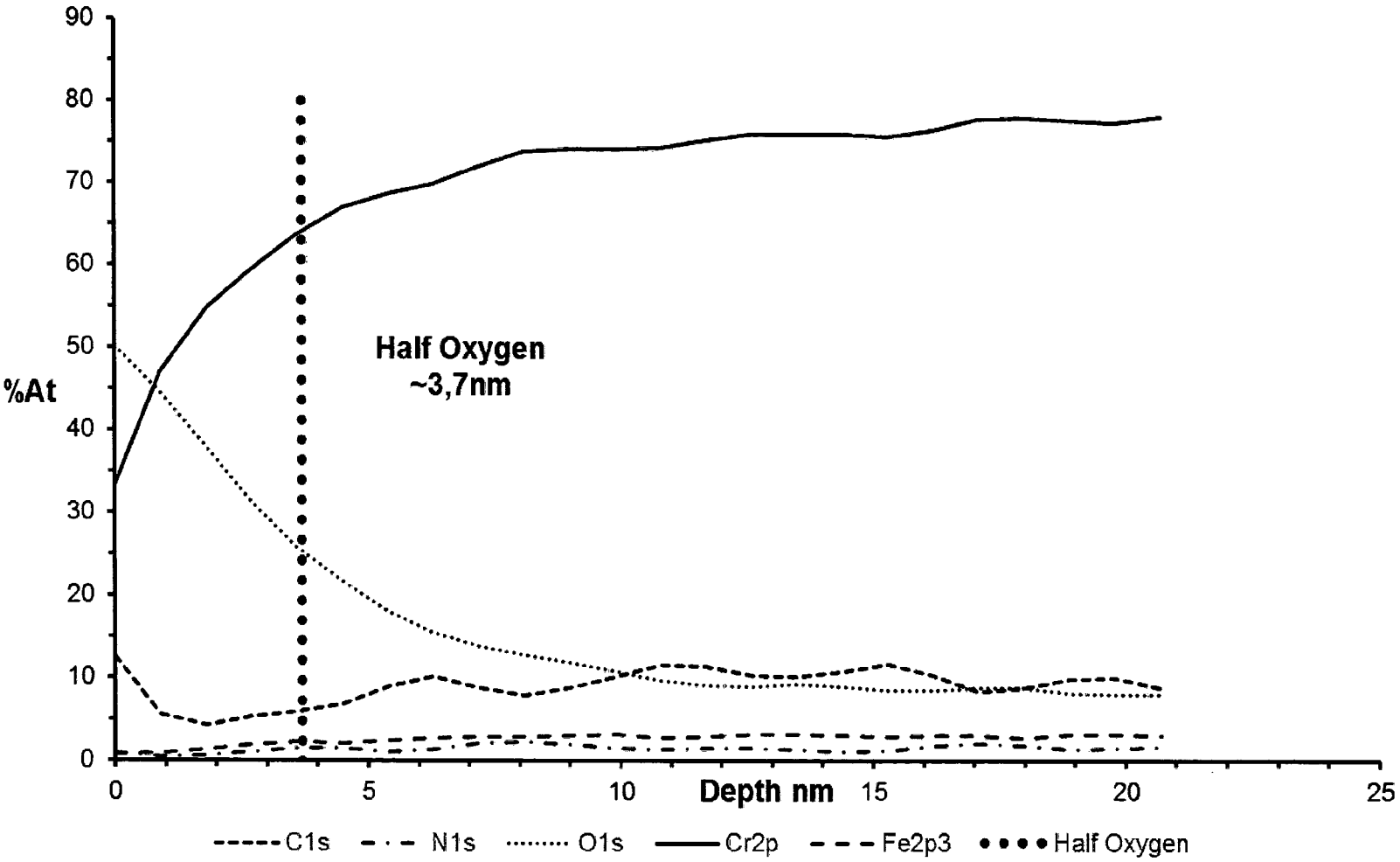
FIG. 4 is a graph that shows the results of XPS profile analysis in the chrome-plated surface obtained by an electrolyte based on trivalent chromium chloride, which was treated with a cathodic post treatment based on trivalent chromium as described in example 10.
Figure 5:
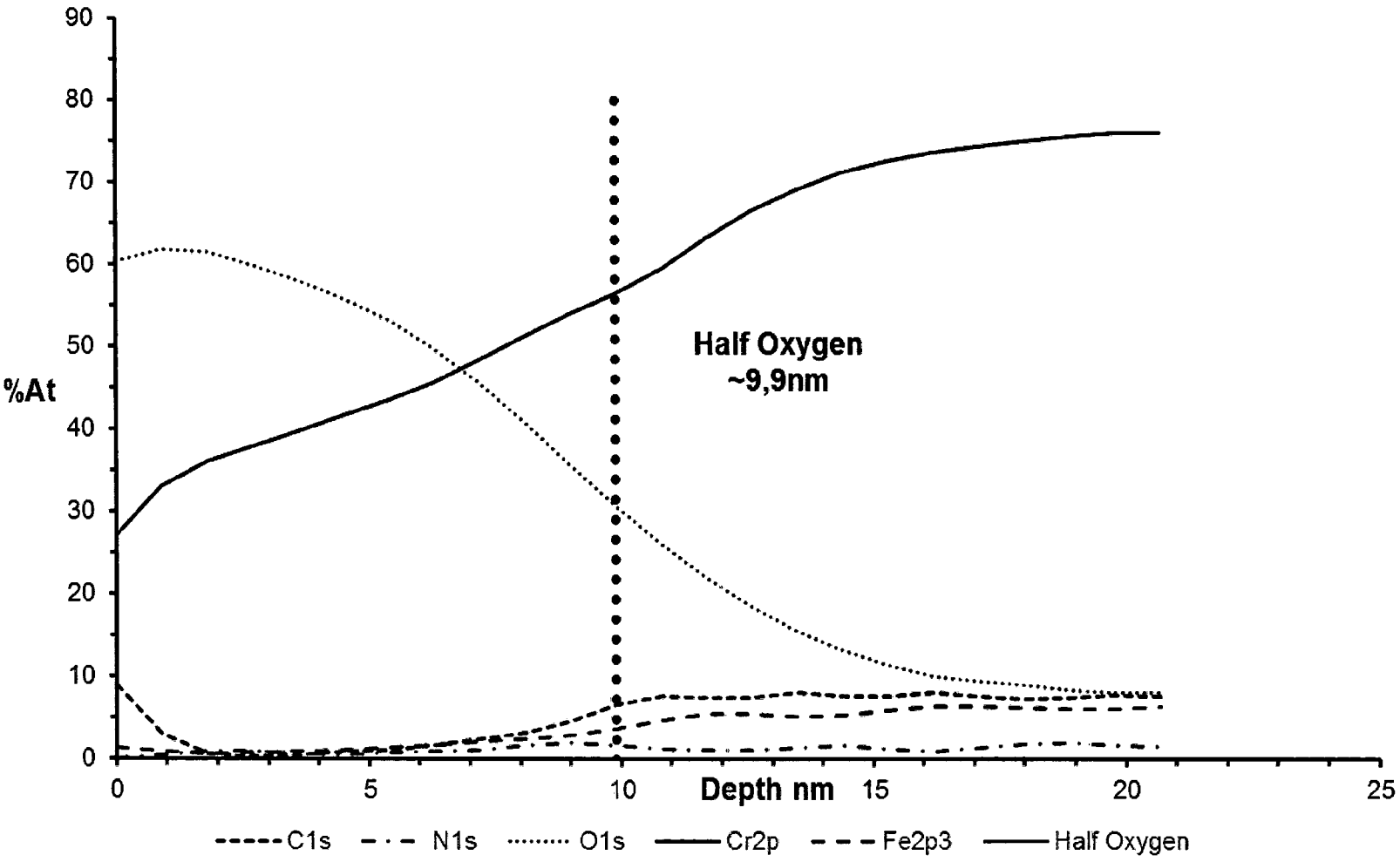
FIG. 5 is a graph that shows the results of XPS profile analysis in the chrome-plated surface obtained by an electrolyte based on trivalent chromium chloride, which was treated with a pulse reverse current, in a post treatment based on Trivalent Chromium as described in example 13.

ABS parts having all the same shape and size have been preliminarily treated to make the surface conductive, suitable for electroplating.

Therefore, the very ones have been treated with conventional electroplating processes such as copper, semi-bright nickel, bright nickel, microporous nickel and chrome.

Different chrome deposits have been tested, all of them coming from trivalent chromium electrolytes: one electrolyte based on chlorides to obtain a clear Cr deposit; one electrolyte based on sulfates to obtain a clear Cr deposit, too; one electrolyte based on Chlorides formulated to obtain a dark Chrome deposit.

Examples from 1 to 6 have been taken as a reference to establish the exact corrosion resistance, according to ISO9227 NSST or ASTM b117 standards, of parts without any treatment or of parts that underwent a conventional Cr(VI) treatment.

In the examples from 13 to 15 a post treatment according to the method of the present invention has been used.

All parts have been subjected to the neutral salt spray test according to the above-mentioned standards. Parts have been inspected every 120 h, rinsing parts with demineralized water and drying them to highlight possible corrosion points. Parts have been considered as conform when there were no spots for more than 5% of the whole surface. If spots exceeded the herein value, parts were considered as not conform ("No" in table 1).

In addition to that, after treating parts, the Cr(VI) presence in the electrolyte used in post-treatment has been checked. 1,5-Diphenylcarbazide has been used as reactive agent, to highlight Cr(VI) presence according to IRSA-CNR 3150 Chromium method C.

In addition, for examples 1, 4, 10 and 13, the chrome-plated surface has been analyzed after the post-treatment to determine its film thickness and type. The samples have been analyzed by XPS. Argon gun profiles have been performed to evaluate the thickness of the top surface chromium oxide layer. The XPS profile has been obtained (in atomic %) for the different elements depending on depth. The estimated chromium oxide layer on the surface of the samples is measured at the half of maximum oxygen concentration. XPS analysis profiles are shown in FIGS. 2, 3, 4 and 5.

All samples were analyzed by XPS using a ESCA-5000 (Physical Electronics) Versa Probe system. The following X ray settings were used: beam size diameter: 200 μm; beam power: 50 W; voltage: 15 kV. The pressure in the analysis chamber was typically 2.10-6 Pa. The XPS data were collected using monochromatic AlKalpha radiation at 1486.6 eV. Photoelectrons were collected at take-off angle of 45° (normal detection) to the surface normal. For all samples, argon profile was made ($Ar^+$ 500 V sputtered area: 2×2 $cm^2$). The sputter rate on $SiO_2$ was measured to be 0.9 nm/min (measured just before samples profiling). The profiles were performed with a step of 0.9 nm depth (1 min sputtering between 2 acquisitions). At each step, the elements were analyzed with a pass energy of 23.5 eV (high resolution spectra): Atomic compositions were derived from peak areas using photoionisation cross-sections calculated by Scofield, corrected for the dependence of the escape depth on the kinetic energy of the electrons and corrected for the analyzer transmission function of our spectrometer. Atomic compositions were derived from peak areas after a Shirley background subtraction.

The measurements were performed by Materia Nova Materials R&D centre in Mons (Be).

Example 1 (Reference)

A clear chromium deposit obtained from trivalent chromium chloride based electrolyte without post treatment.

Example 2 (Reference)

A clear chromium deposit obtained from trivalent chromium sulfate based electrolyte without post treatment.

Example 3 (Reference)

A dark chromium deposit obtained from trivalent chromium chloride based electrolyte without post treatment.

Example 4 (Reference)

A clear chromium deposit obtained from trivalent chromium chloride based electrolyte, which was treated with a cathodic post treatment based on hexavalent chromium.

Example 5 (Reference)

A clear chromium deposit obtained from trivalent chromium sulfate based electrolyte, which was treated with a cathodic post treatment based on hexavalent chromium.

Example 6 (Reference)

A dark chromium deposit obtained from trivalent chromium chloride based electrolyte, which was treated with a cathodic post treatment based on hexavalent chromium.

Example 7

A clear chromium deposit obtained from trivalent chromium chloride based electrolyte, which was treated with a cathodic post treatment based on trivalent chromium.

Electrolyte:

0.05 M Cr(III) introduced as basic chromium sulfate 0.02 g/L sodium gluconate pH=3.5

Parameters of Cathodic Post Treatment:

$j=0.5\ A/dm^2$; t=120 sec; $\Theta=25°$ C.

Example 8

A clear chromium deposit obtained from trivalent chromium sulfate based electrolyte, which was treated with the cathodic post treatment based on trivalent chromium that has been previously mentioned on the example 7.

Example 9

A dark chromium deposit obtained from trivalent chromium chloride based electrolyte, which was treated with the cathodic post treatment based on trivalent chromium that has been previously mentioned on the example 7.

Example 10

A clear chromium deposit obtained from trivalent chromium chloride based electrolyte, which was treated with a cathodic current post treatment based on trivalent chromium.

Electrolyte:

0.002 M Cr(III) introduced as basic chromium sulfate 0.01 M etidronic acid or 1-hydroxyethane 1.1-diphosphonic acid (HEDP):

15 g/L sodium bicarbonate 1 g/L ascorbic acid pH=9.5

Parameters of cathodic current post treatment:

$j=0.1\ A/dm^2$; t=120 sec; $\Theta=25°$ C.

Example 11

A clear chromium deposit obtained from trivalent chromium sulfate based electrolyte, which was treated with the cathodic current post treatment mentioned on the example 10.

Example 12

A dark chromium deposit obtained from trivalent chromium chloride based electrolyte, which was treated with the cathodic current post treatment mentioned on the example 10.

Example 13

A clear chromium deposit obtained from trivalent chromium chloride based electrolyte, which was treated with a pulse reverse current post treatment based on Trivalent Chromium.

Electrolyte:

0.002 M Cr(III) introduced as basic chromium sulfate 0.01 M etidronic acid or 1-hydroxyethane 1.1-diphosphonic acid 15 g/L sodium bicarbonate 1 g/L ascorbic acid pH=9.5

Parameters of Pulse Reverse Current Post Treatment:

$j_{ano}=0.1\ A/dm^2$; $j_{cat}=0.1\ A/dm^2$; f=5 Hz;

duty cycle $\gamma=t_{cat}/(t_{cat}+t_{ano})=50\%$; t=120 sec; $\Theta=25°$ C.

Example 14

A clear chromium deposit obtained from trivalent chromium sulfate based electrolyte, which was treated with the pulse reverse current post treatment mentioned on the example 13.

Example 15

A dark chromium deposit obtained from trivalent chromium chloride based electrolyte, which was treated with the pulse reverse current post treatment mentioned on the example 13.

Table 1 summarizes the tests and analysis results. Examples 13, 14 and 15 have been performed according to the method of the present invention while examples 1 to 12 are reference samples. Therefore, the mentioned examples achieved the targeted goal to obtain a corrosion resistance, according to the ISO 9227 NSST Standard, comparable or higher than a post-treatment done using hexavalent chromium, even if Cr deposit type or Cr alloy varies and avoiding the hexavalent chromium formation into the post-treatment electrolyte. The goal achievement has been confirmed by XPS analysis profile, which highlighted how the use of pulse reverse current on the same electrolyte allows to form a thicker Cr(III) oxide film.

FIG. 1 highlights the pulsed reverse current type applied on the above mentioned examples, leading to the achievement of the objective of the present invention.

TABLE 1

Summary of post treatment performances

| Examples | Chromium color | Chromium electrolyte based | Kind of post treatment | Cr (VI) presence after use in the electrolyte | 120 h | 240 h | 360 h | 480 h | 600 h | 720 h | 840 h | 960 h | Thickness by XPS (nm) |
|---|---|---|---|---|---|---|---|---|---|---|---|---|---|
| 1 | Bright | Chloride | — | — | Ok | No | No | — | — | — | — | — | 2.7 |
| 2 | Bright | Sulfate | — | — | Ok | No | No | — | — | — | — | — | — |
| 3 | Dark | Chloride | — | — | Ok | No | No | — | — | — | — | — | — |
| 4 | Bright | Chloride | Cathodic Cr (VI) | Yes | Ok | Ok | Ok | Ok | Ok | Ok | Ok | Ok | 4.3 |
| 5 | Bright | Sulfate | Cathodic Cr (VI) | Yes | Ok | Ok | Ok | Ok | Ok | Ok | Ok | Ok | — |
| 6 | Dark | Chloride | Cathodic Cr (VI) | Yes | Ok | Ok | Ok | Ok | Ok | Ok | Ok | Ok | — |
| 7 | Bright | Chloride | Cathodic Cr (III) | Yes | Ok | Ok | Ok | No | No | — | — | — | — |
| 8 | Bright | Sulfate | Cathodic Cr (III) | Yes | Ok | Ok | Ok | No | No | — | — | — | — |
| 9 | Dark | Chloride | Cathodic Cr (III) | Yes | Ok | Ok | Ok | No | No | — | — | — | — |
| 10 | Bright | Chloride | Cathodic Cr (III) | No | Ok | Ok | Ok | No | No | — | — | — | 3.7 |
| 11 | Bright | Sulfate | Cathodic Cr (III) | No | Ok | Ok | Ok | No | No | — | — | — | — |
| 12 | Dark | Chloride | Cathodic Cr (III) | No | Ok | Ok | Ok | No | No | — | — | — | — |
| 13 | Bright | Chloride | Pulse Current Cr (III) | No | Ok | Ok | Ok | Ok | Ok | Ok | Ok | Ok | 9.9 |
| 14 | Bright | Sulfate | Pulse Current Cr (III) | No | Ok | Ok | Ok | Ok | Ok | Ok | Ok | Ok | — |
| 15 | Dark | Chloride | Pulse Current Cr (III) | No | Ok | Ok | Ok | Ok | Ok | Ok | Ok | Ok | — |

The invention claimed is:

1. A method for increasing the corrosion resistance of a chrome-plated substrate, the method comprising:

a) dipping at least one part of a chrome-plated surface of a chrome-plated substrate into an electrolyte, the electrolyte comprising trivalent chromium ions, wherein the concentration of the trivalent chromium ions in the electrolyte is in the range of 0.001 to 0.1 M, at least one conducting salt, wherein the concentration of the at least one conducting salt in the electrolyte is in the range of 2 to 50 g/L, and at least one reducing agent, wherein the concentration of the at least one reducing agent in the electrolyte is in the range of 0.1 to 50 g/L, and b) forming a trivalent chromium oxide film on the at least one part of the chrome-plated surface by applying a pulse reverse current between the chrome-plated surface and a counter electrode electrically connected with the chrome-plated surface through the electrolyte;

wherein the pulse reverse current is applied for a time period from 30 to 300 seconds.

2. The method according to claim 1, wherein the applied pulse reverse current has a frequency in the range of 0.1 to 1000 Hz, a current density in the range of 0.01 to 10 $A/dm^2$, and/or a duty cycle in the range of 40 to 95%.

3. The method according to claim 1, wherein the chrome-plated surface of the substrate has been obtained by trivalent chromium electroplating.

4. The method according to claim 1, wherein the substrate comprises a main part made of plastic and at least one under layer arranged on the main part, wherein the at least one under layer is composed of a deposit selected from a metal, a metal alloy or mixtures thereof.

5. The method according to claim 4, wherein the deposit is selected from the group consisting of nickel, alloys of nickel, copper, alloys of copper, and mixtures thereof.

6. The method according to claim 1, wherein the concentration of the trivalent chromium ions in the electrolyte is in the range of 0.002 to 0.08 M.

7. The method according to claim 1, wherein the electrolyte comprises at least one trivalent chromium salt comprising the trivalent chromium ions.

8. The method according to claim 7, wherein the at least one trivalent chromium salt comprising the trivalent chromium ions is selected from the group consisting of chromium sulfate, chromium potassium sulfate, chromium chloride, and mixtures thereof.

9. The method according to claim 1, wherein the at least one conducting salt is selected from the group consisting of sulfates, nitrates, phosphates, carbonates, bicarbonates, acetates, chlorides, and mixtures thereof.

10. The method according to claim 1, wherein the at least one reducing agent is selected from the group consisting of sulfites, metabisulfites, thiosulfates, hydrosulfites, hydrazine, hydroxylamine, hydroxylammonium salts, ascorbic acid and its Na and K salts, formic acid and its Na and K salts, glyoxylic acid and its Na and K salts, glyoxal, glucose, sorbitol, and mixtures thereof.

11. The method according to claim 1, wherein the electrolyte comprises at least one Cr(III) complexing agent.

12. The method according to claim 1, wherein the pH value of the electrolyte is in the range of 2 to 10.

13. The method according to claim 1, wherein the counter electrode is made of stainless steel, graphite, or titanium.

14. The method according to claim 13, wherein the counter electrode is covered by a mixed metal oxide or platinum.

* * * * *